US009407029B2

(12) United States Patent
Jordan

(10) Patent No.: US 9,407,029 B2
(45) Date of Patent: Aug. 2, 2016

(54) ELECTRICAL CONNECTOR

(71) Applicant: ITT Manufacturing Enterprises LLC, Wilmington, DE (US)

(72) Inventor: Peter Jordan, Basingstoke (GB)

(73) Assignee: ITT MANUFACTURING ENTERPRISES, INC., Wilmington, DE (US)

( * ) Notice: Subject to any disclaimer, the term of this patent is extended or adjusted under 35 U.S.C. 154(b) by 0 days.

(21) Appl. No.: 13/999,111

(22) Filed: Jan. 14, 2014

(65) Prior Publication Data

US 2014/0199896 A1 Jul. 17, 2014

(30) Foreign Application Priority Data

Jan. 17, 2013 (GB) ..... 1300845.3

(51) Int. Cl.

| | |
|---|---|
| ***H01R 13/11*** | (2006.01) |
| ***H01R 13/514*** | (2006.01) |
| ***H01R 13/627*** | (2006.01) |
| *H01R 13/645* | (2006.01) |

(52) U.S. Cl.

CPC ..... *H01R 13/514* (2013.01); *H01R 13/6277* (2013.01); *H01R 13/6456* (2013.01)

(58) Field of Classification Search

CPC ..... H01R 13/62; H01R 13/627

USPC ..... 439/855

See application file for complete search history.

(56) References Cited

U.S. PATENT DOCUMENTS

| | | | |
|---|---|---|---|
| 1,583,087 | A | 5/1926 | Morse |
| 2,000,318 | A | 5/1935 | Cannon |
| 2,374,971 | A | 5/1945 | Benander |
| 2,677,811 | A | 5/1954 | Anderson et al. |
| 2,761,111 | A | 8/1956 | Klostermann |
| 2,916,720 | A | 12/1959 | Steans |
| 2,933,711 | A | 4/1960 | Eaton |
| 3,237,147 | A | 2/1966 | Elliott et al. |
| 3,352,576 | A | 11/1967 | Thorne-Thomson |
| 3,747,048 | A | 7/1973 | Johnson et al. |
| 3,768,065 | A | 10/1973 | Zemels |

(Continued)

FOREIGN PATENT DOCUMENTS

| | | | |
|---|---|---|---|
| DE | 4210491 | A1 | 10/1993 |
| DE | 102006006845 | B3 | 7/2007 |

(Continued)

OTHER PUBLICATIONS

Search Report in corresponding European Patent Application No. 13195644.3, dated Mar. 18, 2014, in 8 pages.

(Continued)

*Primary Examiner* — Abdullah Riyami
*Assistant Examiner* — Nader J Alhawamdeh
(74) *Attorney, Agent, or Firm* — Knobbe, Martens, Olson & Bear, LLP

(57) ABSTRACT

An angled electrical connector has a body having an engagement portion including a sleeve which extends in a longitudinal first direction for engaging with a mating electrical connector. The sleeve has a cylindrical inner portion at the base of the sleeve and a tapered portion, such that the opening of the sleeve is larger than the base. A corresponding receptacle part is also provided, having a projecting connection port, with a corresponding cylindrical portion at or near the end.

22 Claims, 6 Drawing Sheets

(56) References Cited

U.S. PATENT DOCUMENTS

| | | | | |
|---|---|---|---|---|
| 3,848,949 | A | 11/1974 | Falkner | |
| 3,962,692 | A | 6/1976 | Murphy et al. | |
| 3,995,930 | A | 12/1976 | Herrmann, Jr. | |
| 4,186,983 | A | 2/1980 | Kaye | |
| 4,364,624 | A | 12/1982 | Williams | |
| 4,708,663 | A | 11/1987 | Eckart | |
| 4,711,510 | A | 12/1987 | Orlando, Jr. | |
| 4,929,188 | A | 5/1990 | Lionetto et al. | |
| 5,195,904 | A | 3/1993 | Cyvoct | |
| 5,288,242 | A | 2/1994 | Muzslay | |
| 5,743,754 | A | 4/1998 | Cristich | |
| 5,911,595 | A | 6/1999 | Orr et al. | |
| 5,938,465 | A | 8/1999 | Fox, Sr. | |
| 6,224,421 | B1 | 5/2001 | Maturo, Jr. | |
| 6,332,815 | B1 | 12/2001 | Bruce | |
| 6,709,289 | B2 | 3/2004 | Huber et al. | |
| 6,966,781 | B1 | 11/2005 | Bullinger et al. | |
| 7,274,964 | B2 | 9/2007 | Balsells | |
| 7,597,588 | B1 | 10/2009 | Hyzin et al. | |
| 7,632,121 | B2 | 12/2009 | Gonzales et al. | |
| 8,100,707 | B2 | 1/2012 | Kussel et al. | |
| 8,375,543 | B1 | 2/2013 | Balsells | |
| 8,496,494 | B2 * | 7/2013 | Jordan | H01R 9/032 439/349 |
| 2006/0046578 | A1 | 3/2006 | Karadimas et al. | |
| 2007/0026695 | A1 | 2/2007 | Lee et al. | |
| 2007/0190868 | A1 | 8/2007 | Cloet et al. | |
| 2008/0166912 | A1 | 7/2008 | Siebens et al. | |
| 2010/0100997 | A1 | 4/2010 | Lee et al. | |
| 2011/0207360 | A1 * | 8/2011 | Jordan | H01R 9/032 439/350 |
| 2014/0199896 | A1 * | 7/2014 | Jordan | H01R 13/514 439/855 |

FOREIGN PATENT DOCUMENTS

| | | | |
|---|---|---|---|
| EP | 0050575 | A1 | 4/1982 |
| EP | 0579551 | A1 | 1/1994 |
| EP | 1819019 | A1 | 8/2007 |
| EP | 2362492 | A1 | 8/2011 |
| GB | 2083296 | A | 3/1982 |
| GB | 2477987 | A | 8/2011 |
| GB | 2509924 | A | 7/2014 |
| NL | 8802529 | A | 5/1990 |
| WO | WO 01/15286 | A1 | 3/2001 |

OTHER PUBLICATIONS

Search Report in corresponding European Patent Application No. 13195644.3, dated Jul. 6, 2015, in 6 pages.

Search Report in corresponding United Kingdom Application No. GB 1300845.3, dated Jul. 9, 2013 in 4 pages.

U.S. Appl. No. 14/876,491 and its prosecution history, filed Oct. 6, 2015, Jordan.

* cited by examiner

*KNOWN ART*

*KNOWN ART*

*KNOWN ART*

*KNOWN ART*

*KNOWN ART*

ELECTRICAL CONNECTOR

CROSS-REFERENCE TO RELATED APPLICATIONS

This application claims priority under 35 U.S.C. §119(a) to GB 1300845.3, which is entitled "Electrical Connector" and was filed Jan. 17, 2013 in UK Intellectual Property Office. The entirety of the aforementioned application is incorporated by reference herein.

TECHNICAL FIELD

This invention relates to an electrical connector for terminating an electrical cable, such as a shielded cable. In particular, the invention relates to a so-called "breakaway" connector, which can be firmly engaged with a mating connector but can be quickly and easily disengaged when required.

BACKGROUND

U.S. Pat. No. 2,761,111 discloses a known breakaway electrical connector for terminating an electrical cable. The electrical connector is arranged to be mechanically engagable with a mating electrical connector to provide an electrically conductive path from the electrical cable to the mating connector. The connectors can be firmly engaged but quickly and easily disengaged when required.

The mating electrical connector described in the US patent is a female connector having a receptacle within which is formed an annular groove. An endless coil spring is retained within the annular groove and partially protrudes therefrom. A plurality of elongate contacts is also arranged within the receptacle and maintained in a parallel longitudinal configuration by a dielectric spacing element.

The cable-terminating connector described in the US patent is a male connector in the form of a plug. A rearward end of the plug is provided with an opening for routing the cable away from the connector in a longitudinal direction. A forward end portion of the plug is provided with an annular groove which is shaped and dimensioned to receive the protruding part of the endless coil spring when the plug and the receptacle of the mating connector are engaged. A plurality of elongate sprung contacts is also arranged within the plug and maintained in a parallel longitudinal configuration by a dielectric spacing element.

The forward tip of the plug is tapered to exert a cam action, whereby an inward thrust of the plug into the receptacle of the mating connector will expand the coil spring to enable the spring to snap into the annular groove formed in the plug, and thus maintain the engagement of the connectors. In this way the sprung contacts of the plug may be held in firm pressure engagement with the fixed contacts of the receptacle to provide the electrically conductive path. The connectors are disengaged by exerting a longitudinal or transverse force on the plug or the cable to thereby expand the coil spring to enable the spring to snap out of the annular groove formed in the plug.

A problem associated with the known breakaway connector arrangement disclosed in U.S. Pat. No. 2,761,111 is that tension on the electrical cable can lead to accidental disengagement of the connectors. Furthermore, tension applied on the cable for deliberately disengaging the connectors may cause excessive stress on the connections and lead to damage.

GB 2 477 987 discloses an angled electrical connector for terminating an electrical cable and for engaging with a mating electrical connector. The angled connector comprises a body having an engagement portion including a sleeve which extends in a longitudinal first direction for engaging with the mating electrical connector, the body further having an opening for routing conductors of the cable away from the connector. At least one resilient member is arranged on the sleeve of the engagement portion, the resilient member being capable of deforming in a transverse direction perpendicular to the first direction and providing a reaction force for maintaining the engagement of the connector with the mating connector.

The opening of the body for routing the conductors of the cable away from the connector is arranged to route the cable in a second direction substantially perpendicular to the first direction. The resilient member comprises a coil spring extending about the sleeve of the engagement portion, the coils of the coil spring having a canted arrangement.

In this design, tension on the cable is less likely to lead to accidental disengagement with a mating electrical connector. In particular, the tension on the cable is in a direction which is substantially perpendicular to the direction of a force required for disengaging the connectors. Furthermore, when the mating connector is mounted in a panel, the connectors may be conveniently disengaged by inserting a user's hand between the panel and the cable to pivoting the cable away from the panel.

This invention relates in particular to the use of this type of connector for connections to fabric, i.e. items of clothing. For example, items of clothing may include built in sensors for monitoring physiological parameters of the wearer, and an electrical interface is required to provide those sensor signals to processing apparatus.

In this context, there is a need for a design which maintains the advantage that accidental disengagement is prevented by pulling on the cable, but which avoids disengagement by a pivoting action. For example, if one of the connectors is mounted in a flexible panel such as an item of clothing, a force resulting in the pivoting release can arise by accident.

BRIEF SUMMARY

According to the invention, there are provided connectors as defined in the claims.

In one aspect, the invention provides an angled electrical connector for terminating an electrical cable and for engaging with a mating electrical connector, the angled connector comprising: a body having an engagement portion including a sleeve which extends in a longitudinal first direction for engaging with the mating electrical connector, the body further having an opening for routing conductors of the cable away from the connector in a second direction substantially perpendicular to the first direction; and at least one resilient member arranged on the sleeve of the engagement portion, the resilient member being capable of deforming in a transverse direction perpendicular to the first direction and providing a reaction force for maintaining the engagement of the connector with the mating connector, wherein the sleeve comprises a cylindrical inner portion at the base of the sleeve and a tapered portion, such that the opening of the sleeve is larger than the base.

This design makes use of a sleeve having a cylindrical part at or near its deepest point, so that release of the electrical connector by pivoting is avoided. Instead, the release needs to be provided by a force along the direction of the sleeve. This is of particular interest for connection to moving objects such as clothing, where lateral forces are likely to be applied to the connector as a result of snagging or contact with objects. The cylindrical portion has a sufficient length to resist pivoting movement of the mated other connector part, but sufficiently short to limit the overall increase in length of the connection. The cylindrical portion may for example extend between 1 mm and 2 mm.

The sleeve can comprise a second cylindrical inner portion at the opening of the sleeve. This also resists pivoting, and may have a length of between 0.5 mm and 2 mm.

A set of projecting connection pins can be provided in a base of the sleeve. The at least one resilient member can comprise a coil spring extending about the sleeve of the engagement portion, and this coil spring can be arranged in and retained by a groove or channel formed in the sleeve of the engagement portion such that a portion of the coil spring protrudes out of the groove or channel.

An alignment notch is preferably provided at a location around the outside of the sleeve.

In another aspect, the invention provides an electrical connector for receiving an angled electrical connector, comprising: a projecting connection port, having electrical contacts within an end face of the port; and a protecting collar circumferentially around the connection port, with an alignment opening interrupting the collar, wherein the connection port comprises a cylindrical outer portion at or near the end and a tapered portion set back from the end, such that the size of the connection port is smaller at the end than at the base.

This aspect provides the connector with which the angled connector can mate. The projecting port has a design such as to avoid angular movement and thereby resist decoupling by a pivoting action. The collar also resists pivoting and thereby ensures a more secure connection, and the opening provides an alignment feature for the connection operation.

As for the other connector part, the cylindrical outer portion has a sufficient length to resist pivoting movement of the mated other connector part, but sufficiently short to limit the overall increase in length of the connection. The cylindrical portion may for example extend between 1 mm and 2 mm.

The electrical contacts can comprise recesses in the end face or pads flush with the end face. An alignment projection can be provided within the alignment opening, for example with a tapered end face.

The invention also comprises a connector arrangement, comprising the angled electrical connector of the invention and the connector of the invention for mating with it.

BRIEF DESCRIPTION OF THE DRAWINGS

An exemplary embodiment of the invention will now be described in detail with reference to the accompanying drawings, which are incorporated herein by reference, in which.

DETAILED DESCRIPTION

The subject matter of the present invention is described with specificity herein to meet statutory requirements. However, this description is not intended to limit the scope of this patent. Rather, it is contemplated that the claimed subject matter might also be embodied in other ways, to include different elements or combinations of elements similar to the ones described in this document, in conjunction with other present or future technologies The invention provides an angled electrical connector for terminating an electrical cable and for engaging with a mating electrical connector.

The invention provides various modifications to the applicant's previous design of GB 2 477 987 to make the design suitable for use when connecting to a fabric article having one connector part provided at its surface. The particular problem of connections to fabric articles (such as a vest) is that the amount of movement in use, and the likelihood of knocking the connection against other objects, means that accidental disconnection is more likely than in static situations.

The design of GB 2 477 987 will first be described, using FIGS. 1 to 4 from GB 2 477 987. Further details can be found in GB 2 477 987.

Figure 1A:
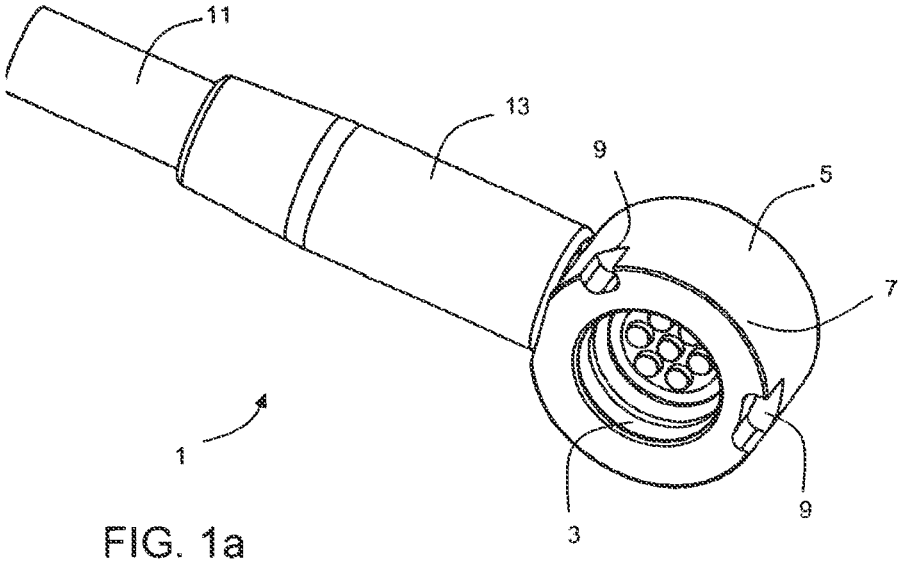
FIG. 1*a* is a perspective view of a known angled electrical connector according to the invention.

FIG. 1*a* shows the underside of the known angled electrical connector 1. The angled connector 1 is a female connector having a receptacle 3 for receiving a male connector (not shown in FIG. 1*a*). A plurality of elongate electrical contacts is arranged within the receptacle 3.

The angled connector 1 comprises a metallic outer body 5 and has an engagement portion including a circular sleeve 7 for engaging the male connector. The sleeve 7 has a generally cylindrical outer shape and extends (axially) in a longitudinal first direction. An outer surface of the sleeve 7 is provided with notches 9 which align with corresponding features of the male connector to ensure correct circumferential alignment when the connectors are brought into engagement. An inner surface of the sleeve 7 has a circular cross section and is provided with engagement means for mechanically coupling the connectors, as will be described in more detail hereinbelow.

The connector body 5 also has a collar portion 13 extending in a second direction which is perpendicular to the first direction. The collar portion defines an elongate opening for routing the inner conductors of a terminated cable 11 away from the connector 1.

Figure 1B:
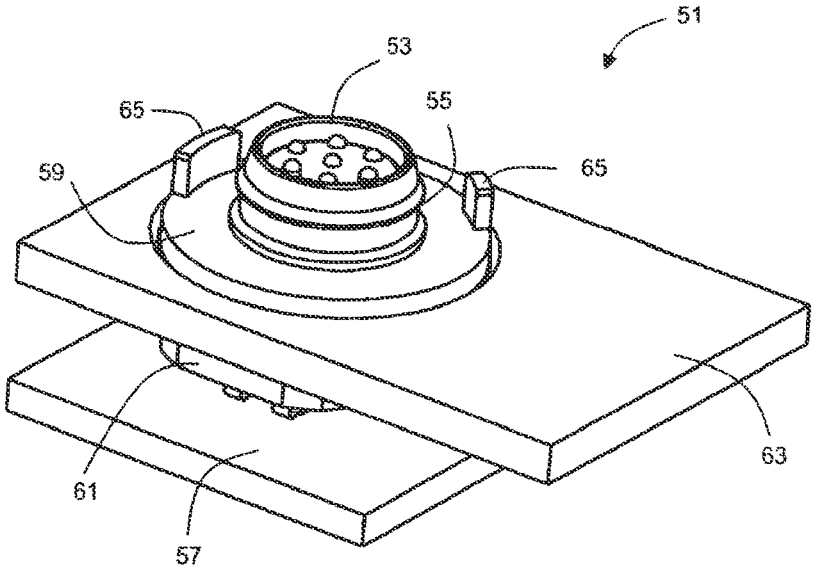
FIG. 1*b* is a perspective view of a known electrical connector for mating with the angled connector shown in FIG. 1.

FIG. 1*b* shows an electrical connector 51 intended for mating with the angled connector 1 shown in FIG. 1*a*. The mating connector 51 is a male connector comprising an outer body 53 formed, for example, of nickel-plated stainless steel. The body 53 of the mating connector 51 has an engagement portion including a longitudinally-extending sleeve 55 for engaging the angled connector 1. A plurality of elongate electrical contacts is arranged within the sleeve 55 for connection to the tracks of a printed circuit board 57. An outer surface of the sleeve 55 is provided with engagement means for mechanically coupling the connectors 1, 51.

The mating connector body 55 also has an annular mounting flange 59, a threaded section (not shown in FIG. 1*b*) adjacent to the mounting flange 59, and a lock nut 61 for mounting the connector 51 to an equipment panel 63. The mounting flange 59 is provided with longitudinally-extending posts 65 which align with the notches 9 formed in the angled connector 1 to ensure correct circumferential alignment when the connectors 1, 51 are brought into engagement.

Figure 2:
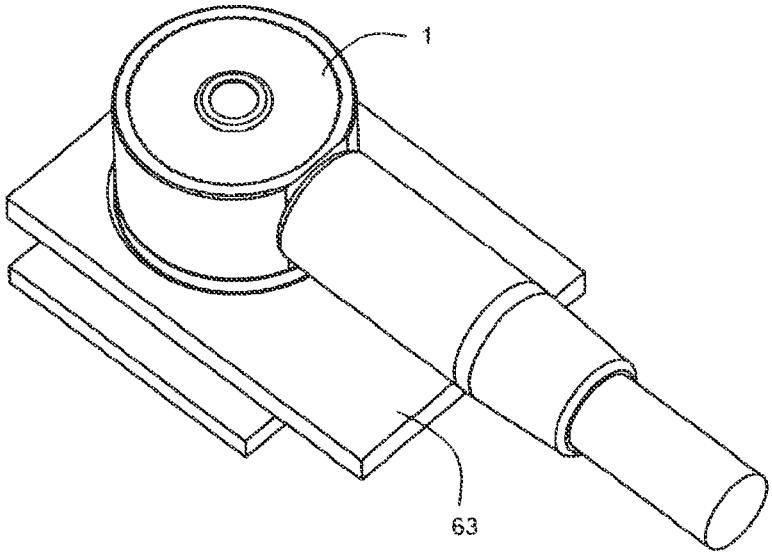
FIG. 2 is a perspective view of the connectors shown in FIGS. 1*a* and 1*b* in the mated configuration.

FIG. 2 is a perspective view of the connectors 1, 51 shown in FIGS. 1*a* and 1*b* in the mated configuration. As will be seen, in the mated configuration, the angled connector 1 entirely covers the portion of the mating connector 51 which is exposed above the equipment panel 63 in which it is mounted.

Figure 3:
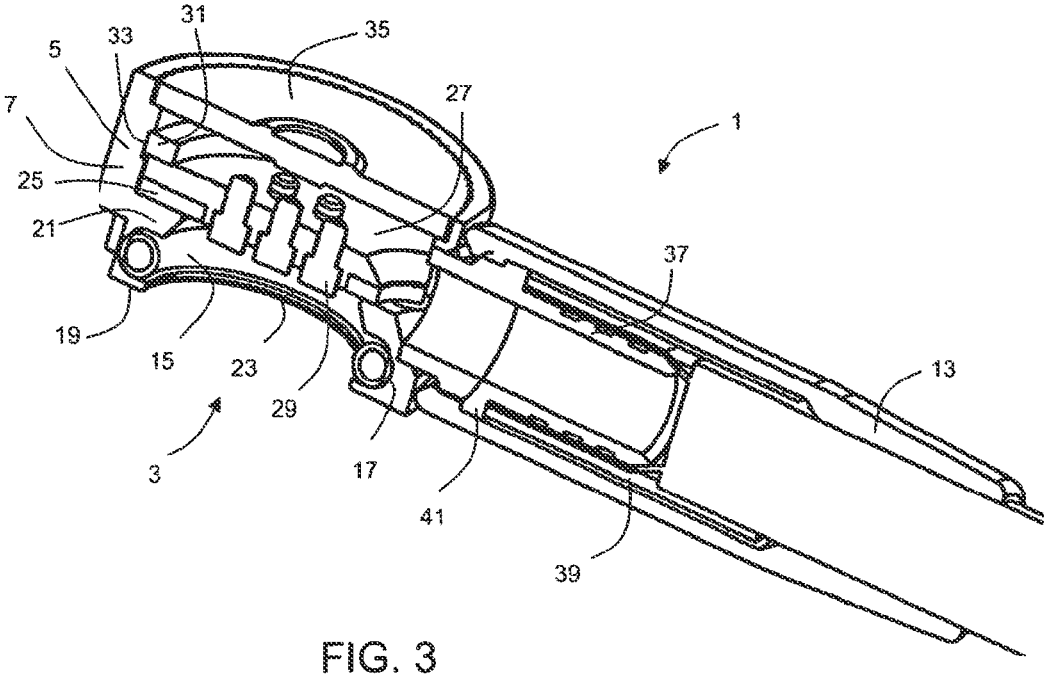
FIG. 3 is a cut-away perspective view showing the connector of FIG. 1*a* in more detail.

FIG. 3 shows the angled connector 1 shown in FIG. 1*a* in greater detail. The Figure shows the connector body 5 and the protective rubber boot 13 described above, together with other features of the connector 1. Thus, the connector 1 further comprises a resilient member in the form of an endless coil spring 15. The coil spring 15 is arranged in and retained by an annular groove 17 formed in the inner surface of the sleeve 7 of the outer body 5. A portion of each coil of the coil spring 15 protrudes from the annular groove, as illustrated. The coil spring 15 has a canted arrangement whereby the coils of the spring are canted with respect to a centerline of the coil spring 15. Thus, entire coils of the coil spring 15 each define an acute angle with a respective plane normal to the centreline of the spring 15. A radial cross section of the canted coil spring 15 has an elliptical shape. The protruding portion of the spring 15 is displaceable in a radially outward direction, thereby compressing the spring and causing increased canting, in response to which a reaction force acts in a radially inward direction.

The groove 17 in which the canted coil spring 15 is arranged is defined by a pair of spaced apart first and second flanges 19, 21 which extend inwardly from the sleeve 7. The first flange 19 is arranged at a forward end of the sleeve 7 and has a distal end which defines an annular abutment surface 23. The abutment surface 23 is parallel to the longitudinal (first) direction and is intended for abutting a corresponding surface of the mating connector 51 for preventing transverse displacement of the connectors 1, 51 with respect to each other when they are in the fully engaged configuration.

The second flange 21 has a distal end which defines a frustro-conical surface. The frustro-conical surface is intended for longitudinally and transversely locating the connector 1 with respect to the mating connector 51 as the connectors 1, 51 are brought into engagement.

The connector 1 further comprises an electrical contact assembly which is housed within the sleeve 7 of the connector body 5, behind the second flange 21. The electrical contact assembly comprises an annular seal 25, a dielectric spacing element 27 provided with a plurality of through holes extending in the first direction, and a plurality of fixed elongate conductive solder contacts 29 arranged in respective through holes of the spacing element 27 for providing electrical connections. The annular seal 25 of the contact assembly is maintained in pressure contact with the second flange 21 by a resilient retaining ring 31 which is received in a second groove 33 formed in the inner surface of the sleeve 7 and bears against the spacing element 27.

A rearward end of the sleeve 7 is provided with a disc-shaped shielding cap 35 which covers the electrical contact assembly and is attached to the body 5 after the inner conductors of the terminated cable have been soldered to the solder contacts 29. A space between the electrical connection assembly and the shielding cap 35 may be potted with a sealant material for additional protection against ingress of moisture and other contaminants.

The collar portion 37 of the connector body 5 is clearly visible in FIG. 3. As described above the collar portion 37 provides an elongate opening extending in the second direction for routing the inner conductors of the cable. An outer surface of the collar portion 37 defines a crimp barrel for receiving the outer conductor, or braid, of the cable and over which a ferrule 39 is crimped in a conventional manner which will be well understood by the skilled person. The collar portion 37 is provided with the protective boot 13, as illustrated in the Figure, which is maintained in position by engagement with a circumferential flange 41 formed on the outer surface of the collar portion 27.

Figure 4:
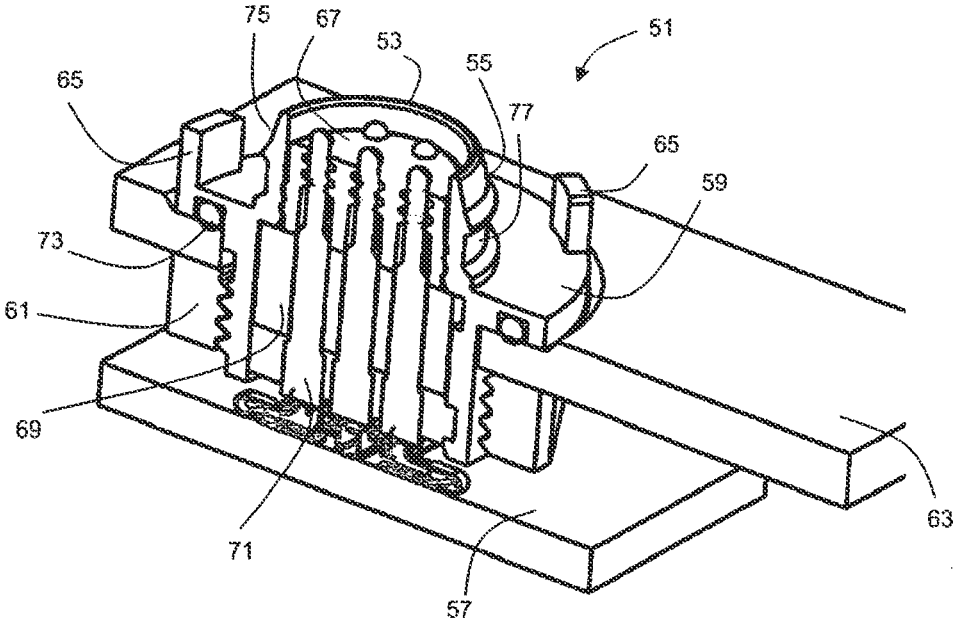
FIG. 4 is a cut-away perspective view showing the connector of FIG. 1*b* in more detail.

FIG. 4 shows the mating connector 51 shown in FIG. 1*b* in greater detail. The Figure shows the connector body 53 and lock nut 61 described above, together with other features of the connector 51. Thus, the connector further comprises an electrical contact assembly which is housed within the sleeve 55 of the connector body 53. The electrical contact assembly comprises a resilient seal 67, a dielectric spacing element 69 provided with a plurality of through holes, and a plurality of elongate conductive solder contacts 71 arranged in respective through holes of the spacing element 69 for providing electrical connections. The solder contacts 71 may, for example, be soldered directly to the conductive tracks of a printed circuit board 57, as illustrated. The solder contacts 71 are so-called pogo contacts in that they are provided as two parts which can be pressed together against the action of a compression coil spring (not shown) arranged inside the contacts 71. The use of such sprung contacts ensures a firm pressure engagement between the contacts 29, 71 of the two connectors 1, 51 when the connectors 1, 51 are in the mated configuration.

The mounting flange 59 of the mating connector 51 is provided with a groove in its surface which faces the mounting panel 63. A resilient sealing member, such as a rubber "O" ring is received in the groove for preventing ingress of moisture and other contaminants between the connector 51 and the panel 63.

An outer surface of the sleeve 55 of the connector body 53 is profiled to define a cam surface for bearing against the canted coil spring 15 of the angled connector 1 when the connectors 1, 51 are brought into engagement with each other. In particular, a forward end of the outer surface of the sleeve 55 is provided with a substantially frustro-conical (tapered) surface 75 having a diameter which gradually increases away from a leading edge of the sleeve 55. The frustro-conical surface 75 leads into a circumferential groove 77 which is arranged for receiving the canted coil spring 15 when the connectors 1, 51 are in the mated configuration. The frustro-conical surface 75 serves two purposes: firstly, it progressively bears against and displaces the canted coil spring 15 when the connectors 1, 51 are brought into engagement, as mentioned above, so that the coil spring 15 is able to compress and then snap into the groove 77. Secondly, it may cooperate with the corresponding frustro-conical surface of the angled connector 1 to longitudinally and transversely locate the connectors 1, 51 with respect to each other as they are brought into engagement.

A portion of the outer surface of the sleeve 55 of the connector body 53 adjacent to the mounting flange 59 is provided with an annular abutment surface 79. The abutment surface 79 is parallel to the connector axis and is intended for abutting the corresponding surface of the angled connector 1 for preventing transverse displacement of the connectors 1, 51 with respect to each other when they are in the fully engaged configuration.

This invention provides various design changes to make the connector more suitable for use in fabric/textile articles, i.e. where the "equipment panel" 63 in FIG. 1*b* is a flexible substrate. The connection mechanism remains essentially the same, with the same use of a circumferential spring which is a snap fit into a channel.

In one embodiment, the modifications comprise: reversing the gender, so that the fixed pins are part of the removable connector part, and the pin recesses or contact pads are on the receptacle part on the fabric side; improvement of the mating arrangement for easier alignment; a wipe clean design for the receptacle part of the connector on the fabric side; and layout change to avoid pivoting disconnection.

Figure 5:
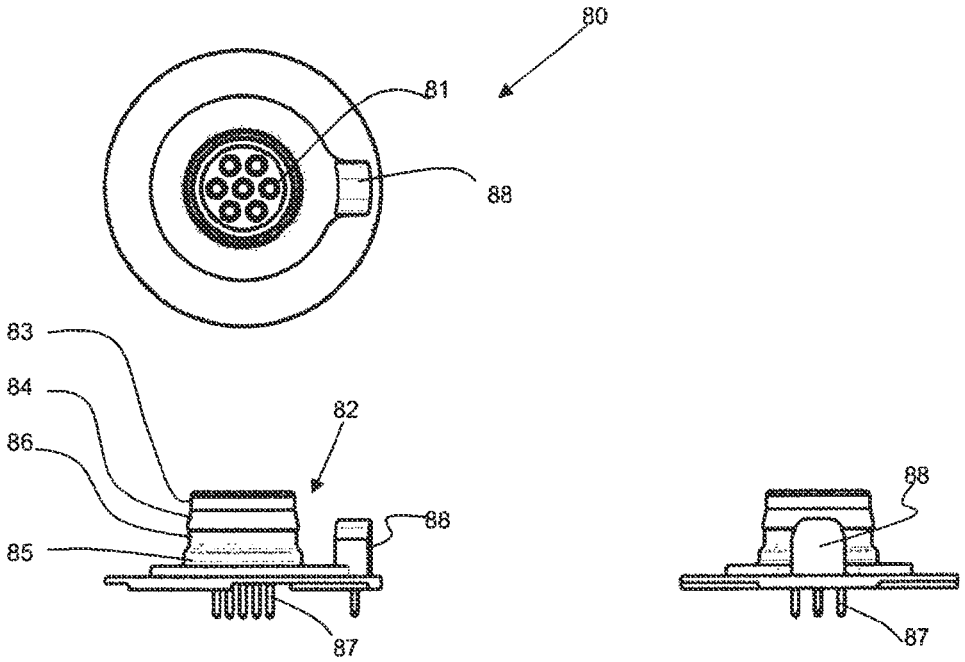
FIG. 5 shows one part of the connector arrangement of the invention.

FIG. 5 shows the receptacle part 80 of the connector, which is to be applied to the fabric substrate. The plug in part will be termed the "connector part", in contrast to the "receptacle part".

The receptacle part has a projecting connector port 82, at the end of which are provided the pin recesses 81, has a different design to eliminate the possibility of a pivoting release of the connector.

The projecting connector port 82 has a cylindrical portion 83 at or near its end, instead of a tapered portion. The cooperation of this cylindrical portion with a corresponding cylindrical part of the connector part resists pivoting movement. The addition of a cylindrical section increases the overall projection length (i.e. the height of the connector), but it is preferably still as small as possible while preventing the rip away of the connector.

The projecting connector port still has a tapered part 84 so that the end face is smaller than the base. This relaxes the alignment of the two connector parts.

The projecting connector port also has a cylindrical part 85 at its base. A recess 86 is between the base and the tapered section 84 for receiving the spring, as in the designs of FIGS. 1 to 4.

In the connected state, there is an area of interface between the two connector parts which is parallel to the projection axis. This prevents pivoting release of the connection.

The projecting connector port is on the outside of a garment. Connecting pins 87 project through the receptacle for connection to a PCB inside the garment, which in turn connects to body sensors, for example.

By providing the pin recesses or pads at the end of the projecting connector port 82 instead of the connection pins, the surface is a wipe clean surface. Furthermore, the pin contacts 81 can be openings or else they can be contact surfaces (for example spring loaded) for making surface contact with the connection pins of the plug (described below) instead of an interference pin-and-socket connection.

If contact surfaces are used, they can be flush with the end surface of the connector or just under the surface to prevent wear and accidental shorting.

To improve the self-alignment, an orientation key 88 has a large taper. The width of the orientation key 88 at its distal end is for example less than 70% of its width at the widest point.

This means that the range of the initial angle of alignment which leads to correct coupling can be increased. The taper angle is in the range 30 to 60 degrees to the plane parallel to the end face of the projecting connector port 82, for example 40 degrees.

Figure 6:
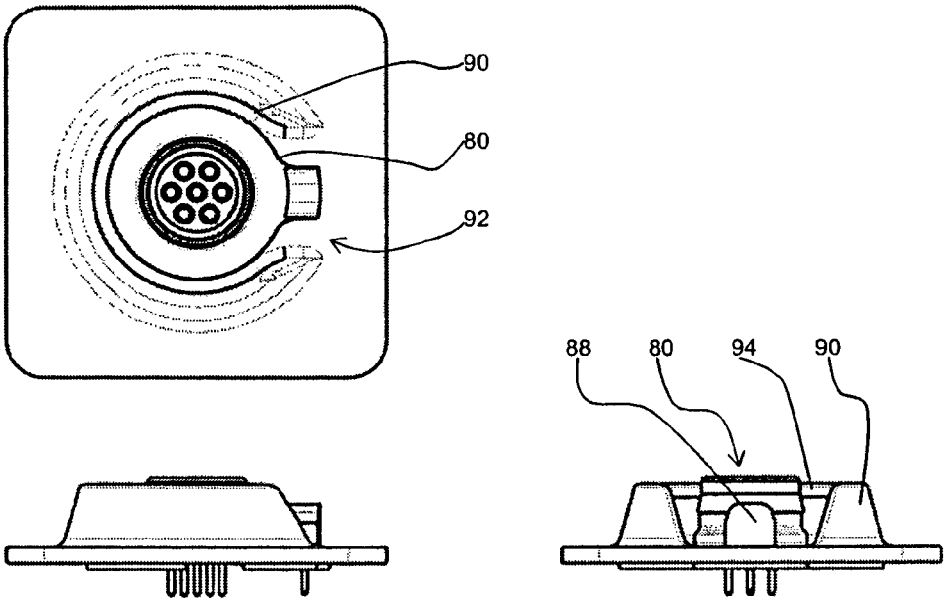
FIG. 6 shows the connector part of FIG. 5 with an outer collar.

FIG. 6 shows the receptacle part 80 fitted within a surrounding collar 90.

The projecting connector port 82 projects within the collar 90 which is integrated into the fabric garment. The collar 90 has a horse shoe shape with an opening 92 at the location where the cable extends from the cable plug part. The opening 92 has a width which enables the cable plug part to be fitted with the permitted range of misalignment which is tolerated by the tapered orientation key design.

The collar 90 protects the connector from lateral forces and provides additional protection from snagging of the interface. The collar 90 can project to approximately the same height as the projecting connector port 82. The top part of the collar has a cylindrical surface 94 which is to engage with the outside of the projecting connector port, and this also functions to prevent pivoting. In this way, the connector part comprises an annulus having an end part which is sandwiched between the projecting connector port 82 and the collar 90.

Figure 7:
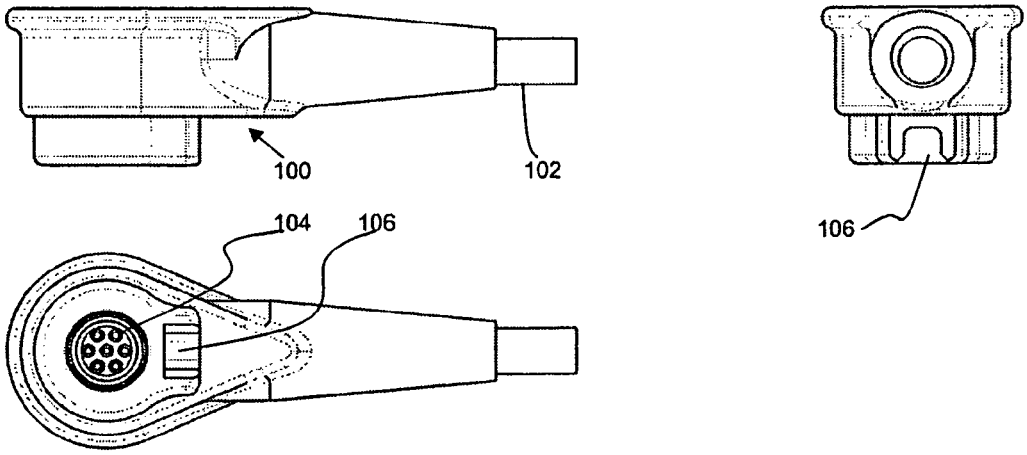
FIG. 7 shows the other part of the connector arrangement of the invention.

FIG. 7 shows the connector part 100 of the connector, which is to be provided at the end of a cable 102.

The connection pins 104 are provided at the base of a recess, and they project a shorter distance than the depth of the recess so that the connecting part can also be wiped clean.

An orientation key recess 106 is provided for receiving the orientation key 88, with a tapered surface at its deep end to match the taper of the key 88.

As mentioned above, the receptacle part 80 is for example fitted to a fabric garment and the connector part 100 enables sensor data to be received from the garment or enables control signals to be provided to the garment.

Figure 8:
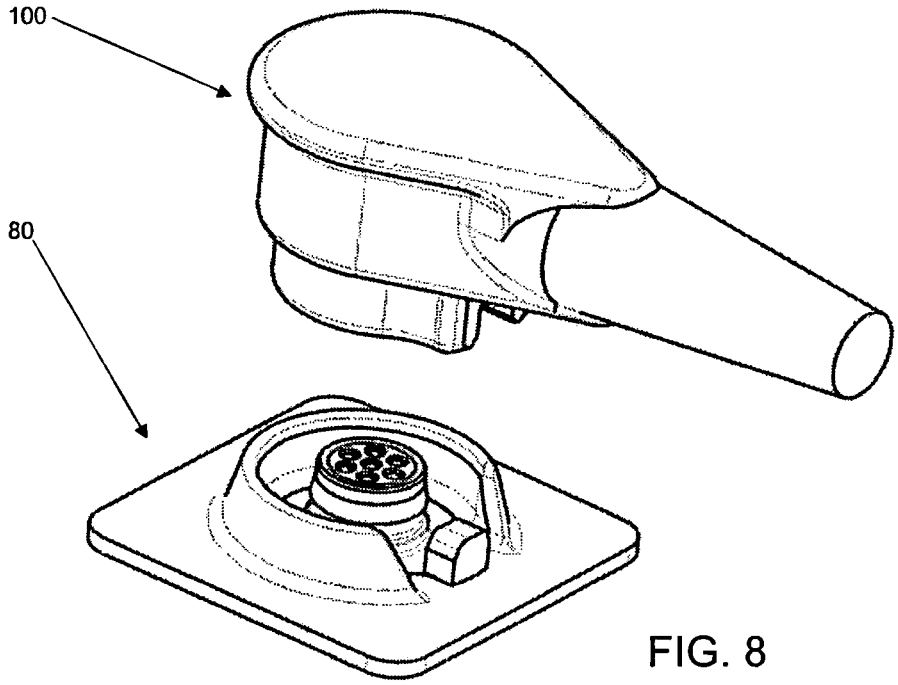
FIG. 8 shows both parts of the connector arrangement of the invention.

FIG. 8 shows the two connector parts being brought into engagement. FIG. 8 also shows that the connector part (the plug) can be fully overmoulded to give additional protection and grips to assist with the required straight mating and unmating operation.

The receptacle part 80 can be moulded into a garment section, or glued, instead of being mounted using a nut and threaded shaft as in the example above. A thin (low profile) PCB can be used with low termination height, to reduce the bulk inside a garment.

Figure 9:
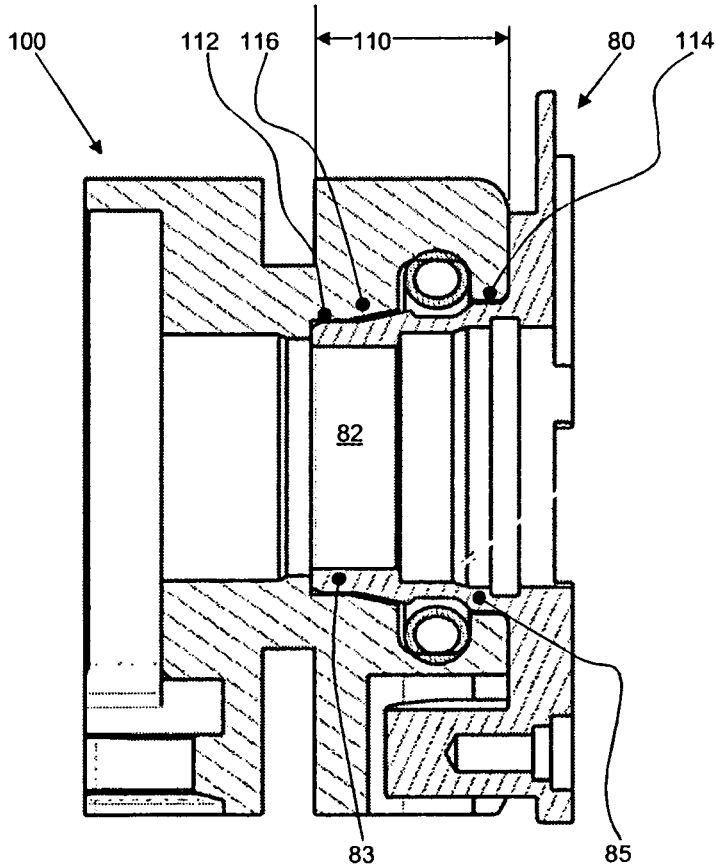
FIG. 9 shows how the two connector parts mate in cross section.

FIG. 9 shows in cross section the connection between the receptacle part 80 and connector part 100. The two cylindrical receptacle parts 83,85 are shown engaged with corresponding parts of the connector part. The connector part has a sleeve 110 for engaging over the projecting connector port 82 of the receptacle. One of the corresponding cylindrical connector parts 112 is at the base of the sleeve 110, and the other 114 is at the sleeve opening. The sleeve 110 also has a tapered part 116. The two cylindrical parts thus function as mating surfaces which resist pivoting movement.

Figure 10:
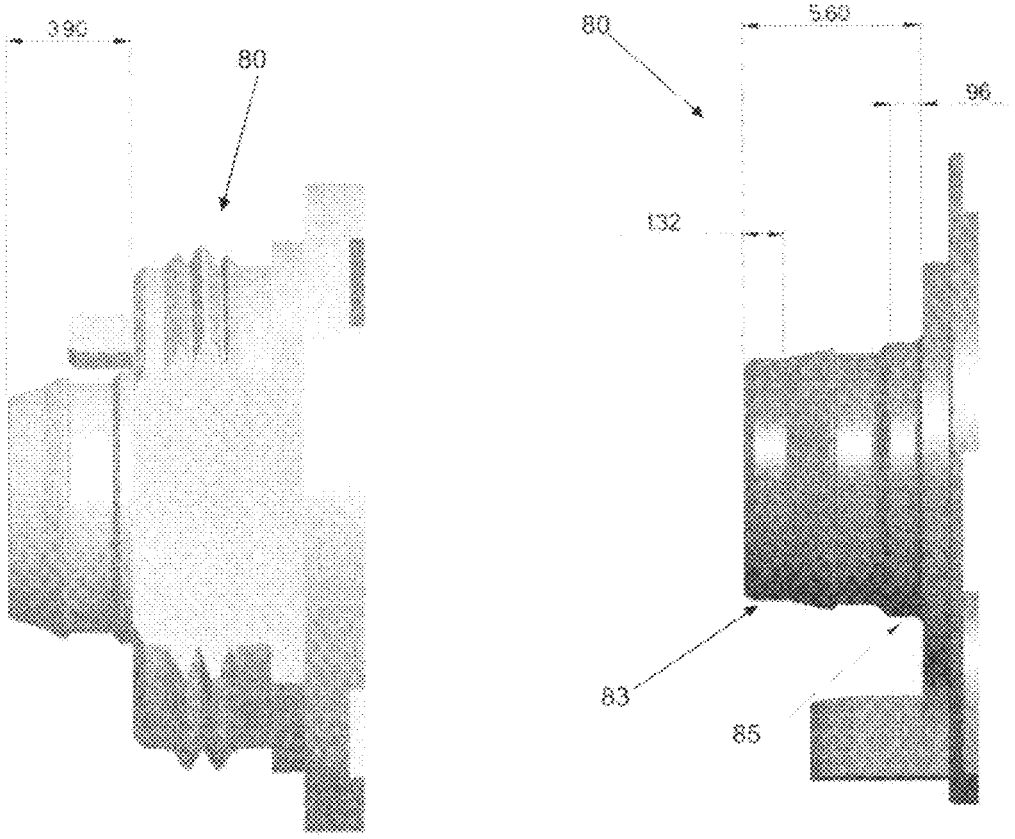
FIG. 10 shows in more detail the design of the projecting connector part.

FIG. 10 shows in more detail the change in the shape of the receptacle part compared to the previous design. It shows the previous design to the left (although without the pins shown) and the modified design to the right. In the example shown, the end cylindrical part 83 has a length of 1.32 mm and the base cylindrical part 85 has a length of 0.96 mm. The overall projecting length is 1.7 mm longer than the previous design.

The cylindrical part is described as at the end of the projection connecting port 82. The may be a small taper at the very end, and this is shown in the drawings. The term "end" should be understood accordingly. The provision of the parallel connection between the connecting part at receptacle as far out from the base of the receptacle provides greatest prevention of pivoting, since the pivot axis is in the plane of the base of the receptacle part. Thus, the further out the cylindrical portion, the greater the distance from the pivot axis and therefore the greater the resistance to pivoting.

The invention can be used for connecting to sensors in body armour, for example.

A specific embodiment of the invention has been described above. Various changes and modifications may be made to the specific embodiment without departing from the invention.

For example, the canted coil spring may be arranged on the mating connector and the cam surface arranged on the angled connector. The canted coil spring could be replaced by a plurality of discrete spring elements spaced about the circumference of either connector.

What is claimed is:

1. An angled electrical connector for terminating an electric cable and for engaging with a mating electrical connector, the angled connector comprising:

a body having an engagement portion including a sleeve which extends in a longitudinal first direction for engaging with the mating electrical connector, the sleeve comprising an opening and a base;

the body further having an opening for routing conductors of the cable away from the connector in a second direction substantially perpendicular to the first direction; and at least one resilient member arranged on the sleeve of the engagement portion, the resilient member being capable of deforming in a transverse direction substantially perpendicular to the first direction and providing a reaction force for maintaining the engagement of the connector with the mating connector, wherein the sleeve further comprises a cylindrical inner portion at the base of the sleeve and a tapered portion, such that the opening of the sleeve is larger than the base of the sleeve, the cylindrical inner portion being configured to engage with a corresponding cylindrical portion of the mating electrical connector.

2. The angled electrical connector of claim 1, wherein the sleeve comprises a second cylindrical inner portion at the opening of the sleeve, the second cylindrical inner portion configured to engage with a corresponding second cylindrical portion of the mating electrical connector.

3. The angled electrical connector of claim 1, comprising a set of projecting connection pins provided in a base of the sleeve.

4. The angled electrical connector of claim 1, wherein the at least one resilient member comprises a coil spring extending about the sleeve of the engagement portion.

5. The angled electrical connector of claim 4, wherein the coil spring is arranged in and retained by a groove or channel formed in the sleeve of the engagement portion such that a portion of the coil spring protrudes out of the groove or channel.

6. The angled electrical connector of claim 1, wherein an alignment notch is provided at a location around the outside of the sleeve.

7. An electrical connector for receiving at least a portion of a mating angled electrical connector, the electrical connector comprising:

a projecting connection port, the connection port having a proximal base and a distal end face;

electrical contacts that are positioned within the distal end face of the connection port; and a protecting collar circumferentially around the connection port, with an alignment opening interrupting the collar, wherein the connection port further comprises:

a cylindrical outer portion at or near the distal end face;

a cylindrical inner portion at or near the proximal base; and a tapered portion that is proximally set back from the distal end face and distally set back from the proximal base, such that the size of the connection port is smaller at the distal end face than at the proximal base.

8. The electrical connector of claim 7, wherein the connection port comprises a second cylindrical outer portion at the base of the port.

9. The electrical connector of claim 7, wherein the electrical contacts comprise recesses in the end face.

10. The electrical connector of claim 7, wherein the electrical contacts comprise pads flush with the end face.

11. The electrical connector of claim 7, wherein an alignment projection is provided within the alignment opening.

12. The electrical connector of claim 11, wherein the alignment projection has a tapered end face.

13. A connector arrangement comprising:

an angled electrical connector that is for terminating a cable and that includes:

a body having an engagement portion including a sleeve which extends in a longitudinal first direction for engaging with a mating electrical connector, the body further having an opening for routing conductors of the cable away from the connector in a second direction substantially perpendicular to the first direction; and at least one resilient member arranged on the sleeve of the engagement portion, the resilient member being capable of deforming in a transverse direction substantially perpendicular to the first direction and providing a reaction force for maintaining the engagement of the connector with the mating electrical connector, wherein the sleeve comprises a cylindrical inner portion at the base of the sleeve and a tapered portion, such that the opening of the sleeve is larger than the base; and the mating electrical connector including:

a projecting connection port, having electrical contacts within an end face of the port; and a protecting collar circumferentially around the connection port, with an alignment opening interrupting the collar, wherein the connection port comprises a cylindrical outer portion at or near the end and a tapered portion set back from the end, such that the size of the connection port is smaller at the end than at the base.

14. The connector arrangement of claim 13, wherein:

the angled electrical connector further comprises electrical connection pins; and the mating electrical connector further comprises electrical connection recesses or contact pads, the recesses or contact pads configured to engage with the electrical connection pins when the angled electrical connector is mated with the mating electrical connector.

15. The connector arrangement of claim 13, wherein the protecting collar extends continuously at least 270° around the connection port.

16. The connector arrangement of claim 13, wherein the protecting collar projects to approximately the same height as the connection port.

17. The connector arrangement of claim 13, wherein the protecting collar further comprises a top part with a cylindrical surface, the cylindrical surface configured to reduce pivoting disengagement when the angled electrical connector is mated with the mating electrical connector.

18. The angled electrical connector of claim 1, further comprising an electrical conductor pin that is positioned in a recess, the wherein the pin projects a distance that is less than the depth of the recess such that the pin does not project outward from the recess.

19. The angled electrical connector of claim 1, wherein the body further comprises a lip configured to assist a user with engaging and disengaging the angled electrical connector with a mating electrical connector.

20. The electrical connector a of claim 7, wherein the electrical contacts within the end face of the port comprise recesses or contact pads.

21. The electrical connector of claim 7, wherein the end face of the port is substantially flat and is configured to provide a wipe clean surface.

22. The electrical connector of claim 7, wherein the cylindrical outer portion is configured to be received in a recess in the mating angled electrical connector and to engage with a cylindrical inner wall within the recess of the mating angled electrical connector.

* * * * *